US006830427B2

(12) United States Patent
Lafarge et al.

(10) Patent No.: US 6,830,427 B2
(45) Date of Patent: Dec. 14, 2004

(54) NOZZLE-VANE BAND FOR A GAS TURBINE ENGINE

(75) Inventors: Grégory Lafarge, Lieusaint (FR); Christophe Texier, Migne Auxance (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/303,810

(22) Filed: Nov. 26, 2002

(65) Prior Publication Data

US 2003/0143064 A1 Jul. 31, 2003

(30) Foreign Application Priority Data

Dec. 5, 2001 (FR) ..... 01 15696

(51) Int. Cl.[7] ..... F01D 9/04

(52) U.S. Cl. ..... 415/115; 415/116; 415/178; 415/200

(58) Field of Search ..... 415/115, 116, 415/117, 175–178, 200, 191, 208.1, 208.2

(56) References Cited

U.S. PATENT DOCUMENTS 3,628,880 A * 12/1971 Smuland et al. ..... 415/175
3,800,864 A 4/1974 Hauser et al.
4,353,679 A * 10/1982 Hauser ..... 415/115
4,712,979 A * 12/1987 Finger ..... 416/96 R
5,197,852 A * 3/1993 Walker et al. ..... 415/115
5,201,847 A * 4/1993 Whidden ..... 415/177
5,252,026 A 10/1993 Shepherd

FOREIGN PATENT DOCUMENTS

GB 1553701 A * 10/1979 ..... 415/117

* cited by examiner

*Primary Examiner*—Christopher Verdier
(74) *Attorney, Agent, or Firm*—Oblon, Spivak, McClelland, Maier & Neustadt, P.C.

(57) ABSTRACT

A high-pressure turbine nozzle-vane band for a gas turbine engine. The band includes an inside surface supporting at least one guide vane having a trailing edge that is directed towards a downstream end of the band, and an outside surface, opposite the inside surface, from which a flange extends radially, defining firstly, upstream from the flange, a passage for cooling-air, and secondly, downstream from the flange, a cavity. The inside surface of the band is provided, between the trailing edge of the guide vane and the downstream end of the band, with a coating forming a thermal barrier enabling a temperature gradient generated in the band by the air spinning in the cavity to be increased.

12 Claims, 3 Drawing Sheets

FIG.3
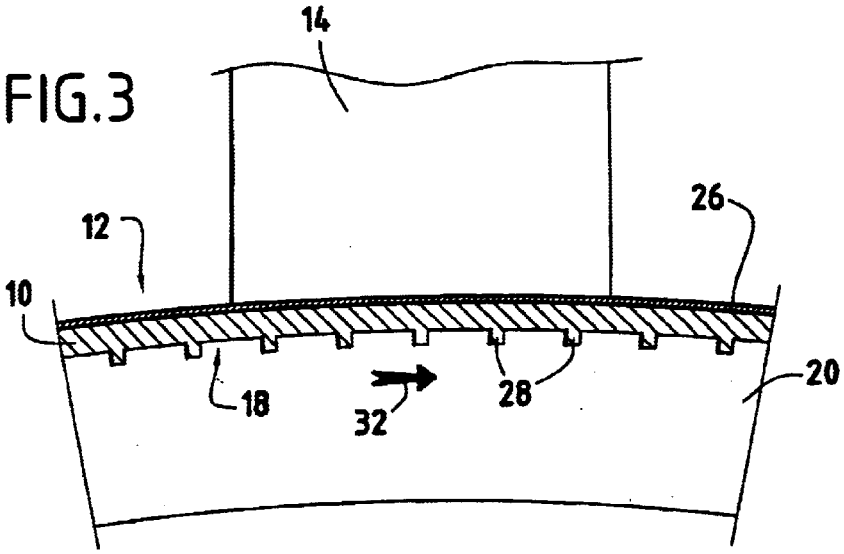
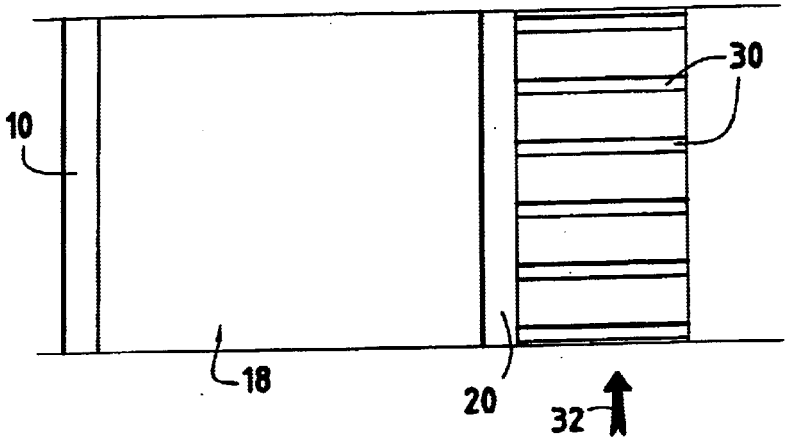
FIG.4A
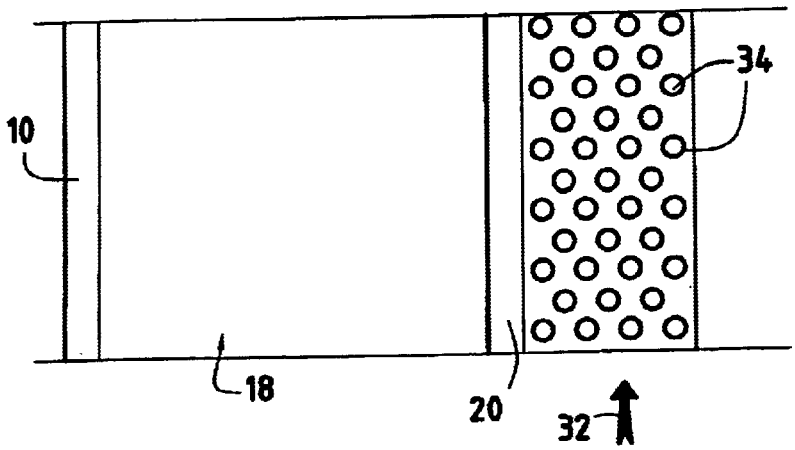
FIG.4B

NOZZLE-VANE BAND FOR A GAS TURBINE ENGINE

BACKGROUND OF THE INVENTION

The present invention relates to the general field of gas turbine engines, and more particularly to the field of high-pressure turbine nozzle-vane bands for a gas turbine engine.

A gas turbine engine typically includes a nacelle which forms an opening for admitting a determined flow of air towards the engine proper. Generally, the engine includes a compression section for compressing the air admitted into the engine, and a combustion chamber in which the air compressed in this way is mixed with fuel and then burnt. The gases generated by said combustion are then directed towards a high-pressure turbine before being exhausted.

The high-pressure turbine conventionally includes one or more rows of turbine vanes spaced apart circumferentially all around the rotor of the turbine. It also includes a nozzle assembly enabling the flow of gases from the combustion chamber to be directed towards the turbine vanes at an appropriate angle and speed so as to rotate the vanes and the rotor of the turbine.

The nozzle assembly generally comprises a plurality of guide vanes which extend radially between bottom and top annular bands and which are spaced circumferentially relative to one another. The vane bands thus come directly into contact with the hot gases from the combustion chamber. They are subjected to very high temperatures and therefore need to be cooled. The ever increasing temperatures at the outlets of combustion chambers, and the use of chambers having two heads so as to further increase the performance of engines are leading to higher and higher temperatures in the vicinity of the bands. The increasing temperature stresses at the vane bands mean that the techniques used to cool them must be reconsidered.

A cooling device for gas-turbine nozzle bands is known from American patent U.S. Pat. No. 5,197,852. The device comprises, in particular, an internal circuit provided inside the band to enable a cooling fluid to flow through the band and cool said band. In addition to the internal circuit, a thermal-barrier-forming-coating is placed on the side of the band bordering the gas stream, and extends from a zone situated between the vanes as far as the downstream end of the band so as to reduce the temperature gradient between the two sides of the band.

The cooling device of the nozzle band described in that document can turn out to be insufficient, in particular downstream from the guide vanes in the slipstream of their trailing edges where burns can appear. In addition, since the thermal barrier provided is deposited on the throat surfaces of the vanes, it can affect the throat section of the nozzle and degrade the performance of the high-pressure turbine. The zone to be covered by the thermal-barrier-forming coating is also difficult to access (in particular in the channels between vanes), thus leading to an increase in the cost of making the band.

OBJECT AND SUMMARY OF THE INVENTION

The present invention thus seeks to mitigate such drawbacks by proposing a nozzle-vane band including a cooling device to protect the band thermally in a region in which other cooling techniques cannot be used. It also seeks to provide a nozzle band having a cooling device that does not disrupt the throat section of the guide vanes and that does not require a cooling circuit that is inside the band. It also seeks to provide a nozzle band having a cooling system that is not particularly difficult to install. Finally, it seeks to provide a high-pressure turbine nozzle including at least one band of the invention.

To this end, the invention provides a high-pressure turbine nozzle-vane band for a gas turbine engine, the band comprising an inside surface supporting at least one guide vane having a trailing edge that is directed towards a downstream end of the band, and an outside surface, opposite the inside surface, from which a flange extends radially, defining firstly, upstream from the flange, a passage for cooling-air, and secondly, downstream from the flange, a cavity, wherein the inside surface of the band is provided, between the trailing edge of the guide vane and the downstream end of the band, with a coating forming a thermal barrier enabling a temperature gradient generated in the band by the air spinning in said cavity to be increased.

In this way, the presence of the thermal-barrier-forming coating enables the band to be protected from burns which may appear downstream from the guide vanes, in the slipstream of their trailing edges.

So as not to degrade the aerodynamic performance of the high-pressure turbine, the thermal-barrier-forming coating has a surface which is substantially flush with the inside surface of the band upstream from the thermal barrier.

The outside surface of the band advantageously includes spoiler projections extending between the flange and the downstream end of the band so as to increase the temperature gradient generated in the band and thus improve the effectiveness of the thermal barrier.

The spoiler projections can be in the form of ribs that are substantially parallel or inclined relative to the axis of the turbine, or in the form of curvilinear ribs or even studs.

BRIEF DESCRIPTION OF THE DRAWINGS

Other characteristics and advantages of the present invention appear from the following description given with reference to the accompanying drawings which show an embodiment having no limiting character. In the figures:

FIG. 3 is a view in III—III of FIG. 1; and

DETAILED DESCRIPTION OF AN EMBODIMENT

In a gas turbine engine, the gases from the combustion are directed towards a high-pressure turbine including one or more rows of turbine vanes spaced apart circumferentially all around a rotary wheel. The high-pressure turbine also includes a nozzle assembly enabling the flow of gases from the combustion chamber to be directed towards the turbine vanes at an appropriate angle and speed so as to rotate the vanes and the rotary wheel. The nozzle assembly is provided with a plurality of guide vanes which extend radially between a bottom annular band and a top annular band, each band being made of one or more adjacent segments forming a circular and continuous surface.

Figure 1:
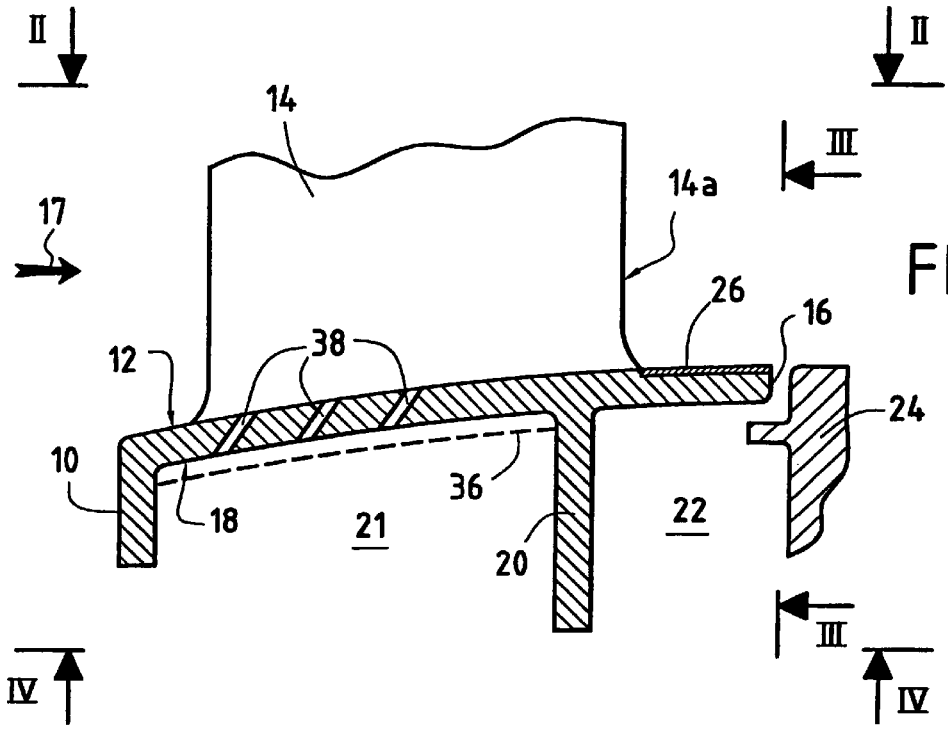
FIG. 1 is a section view of a band of the invention for high-pressure turbine nozzle.

Reference is made to FIG. 1 which is a section view of a vane band of the invention for a high-pressure turbine nozzle. In this figure, a bottom band 10 and a top band 11 are shown. Naturally, the present invention also applies to top bands.

The band 10 includes an inside surface 12 supporting at least one guide vane 14, it being observed that a plurality of guide vanes are evenly spaced apart in circumferential manner all around an axis (not shown) of the high-pressure turbine. The guide vane 14 is disposed on the inside surface of the band 10 in such a manner that its trailing edge 14*a* is directed towards a downstream end 16 of the band, in the flow direction 17 of the hot gases from the combustion chamber.

The band further includes an outside surface 18, opposite the inside surface 12, from which a flange 20 extends radially, said flange being designed to enable the band to be mounted in the gas turbine engine. The flange 20 defines firstly, upstream therefrom, a passage 21 for air intended to cool the band 10, and secondly, downstream therefrom, a cavity 22 defined by the flange and by a rotary wheel 24 of the turbine. The rotary wheel 24 extends radially from the downstream end 16 of the band and supports one or more rows of turbine vanes (not shown).

The terms "inside" and "outside" are used herein with reference to being in or not in the stream of combustion gases. Terms such as "top" and "bottom" are used to denote distance from the axis of the turbine.

Figure 2:
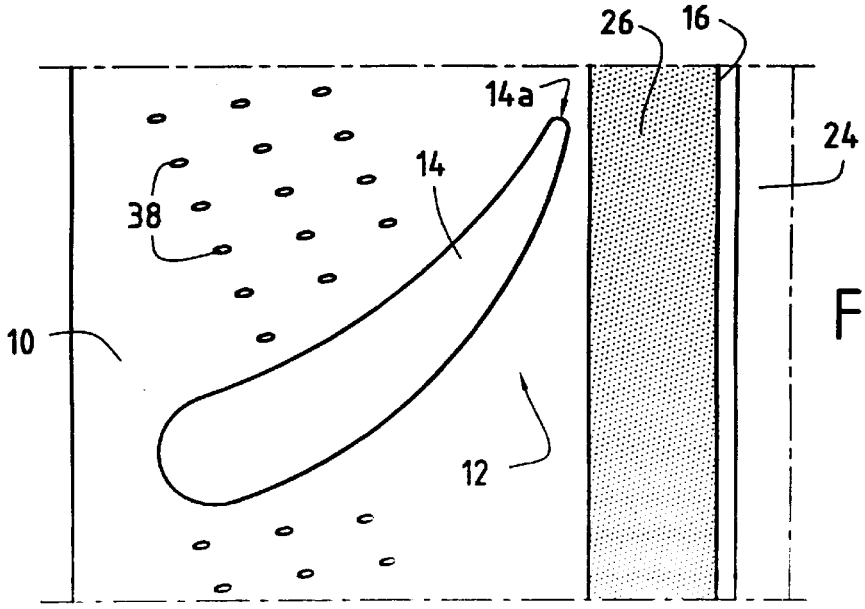
FIG. 2 is a view on II—II of FIG. 1.

In accordance with the invention and as shown in FIG. 2, the inside surface 12 of the band 10 is provided, between the trailing edge 14*a* of the guide vane 14 and the downstream end 16 of the band, with a coating 26 forming a thermal barrier. The coating extends over the entire circumference of the band when said band is a single piece, and over the entire width of each segment when the band is made up of a plurality of adjacent segments.

The coating 26 is, for example, made of a thin layer of ceramic that is typically based on zircon. A connection sublayer can be interposed between the band and the ceramic layer so as to improve adherence of the ceramic layer. The thermal barrier is preferably deposited by a plasma method that is better adapted to localized depositing. It offers the advantage of presenting lower cost of implementation and better mechanical strength compared with a method of physical vapor deposition under an electron beam.

The coating 26 makes it possible to increase a temperature gradient generated in the band 10 by the spinning of the air contained in the cavity 22. The air present in said cavity 22 is rotated by the rotary wheel 24 spinning about the axis of the high-pressure turbine, thereby creating a thermal convection phenomenon along the length of the band 10. This convection enables heat to be evacuated and a temperature gradient to be created in the band in a direction perpendicular to said band. The presence of the thermal-barrier-forming coating 26 thus enables the temperature gradient to be increased and thus ensures that the band is effectively cooled downstream from the flange 20.

According to an advantageous characteristic of the invention, the thermal-barrier-forming coating 26 has a surface which is substantially flush with the upstream end of the inside surface 12 of the band so as not to degrade the aerodynamic performance of the high-pressure turbine by any surface discontinuity. In addition, in order to limit any risk of the thermal barrier degrading, said barrier is, in particular, deposited downstream from the throat, i.e. downstream from a connection zone between the guide vane 14 and the inside surface 12 of the band 10.

In FIG. 3, it should be observed that the cavity 22 is advantageously provided, on the outside surface 18 of the band, with spoiler projections 28 extending between the flange 20 and the downstream end 16 of the band. The spoiler projections enable the above-described thermal convention phenomenon to be increased and thus enable the effectiveness of the thermal barrier to be improved.

Figure 4C:
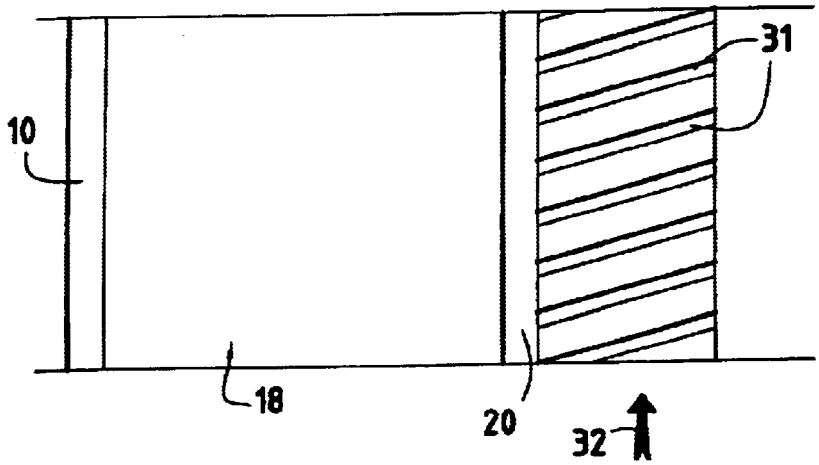
FIGS. 4A and 4D are views on IV—IV of FIG. 1 showing several embodiment examples of spoiler projections.
Figure 4D:
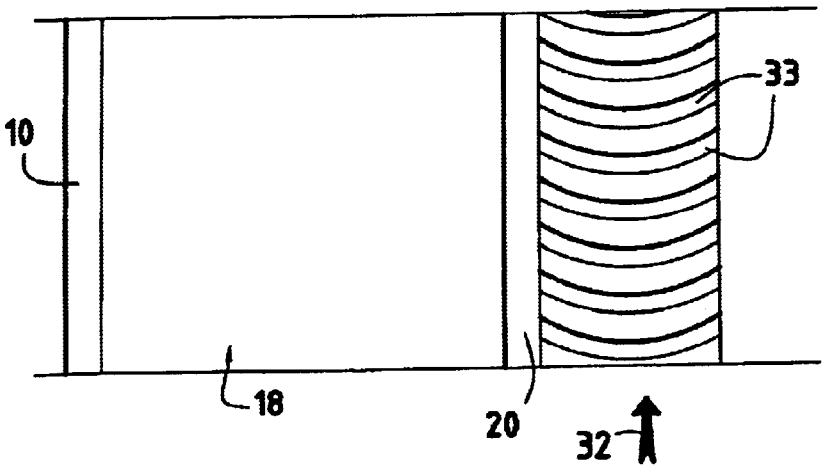

Reference is made to FIGS. 4A and 4B which show two examples of the spoiler projections.

In FIG. 4A, the spoiler projections are presented in the form of ribs 30 projecting radially from the outside surface 18 of the band and extending substantially parallel to an axis of the turbine. The ribs thus cross the flow 32 of air contained in the cavity 22 so as to disrupt said flow. Naturally, it is also possible to envisage the ribs being substantially inclined relative to the axis of the turbine as represented by reference 31. The ribs can also be curved, e.g. extending in a general direction that is parallel to the axis of the turbine, as represented by reference 33.

In FIG. 4B, the spoiler projections are formed by studs 34 projecting radially from the outside surface 18 of the band. In this figure, the studs 34 are disposed in staggered rows. They could also be aligned in rows that are substantially parallel to the axis of the turbine. In addition, the spoiler projections could comprise both ribs and studs.

The band as described above can also be provided with currently-used devices for cooling the central and upstream portions of the band. As shown in FIG. 1, for example, the band can include, upstream from the flange 20, at least an impact sheet 36 fixed on the outside surface 18 so as to ensure that the band is cooled by impact. Alternatively, the band can be pierced, upstream from the flange 20, by a plurality of air passing holes 38 that extend between the inside and outside surfaces and that are slightly inclined relative to a radial direction so as to create a cooling film for cooling the inside surface of the band. The provision of an impact sheet cannot be envisaged at the downstream end of the band because of the small size of the cavity 22 and the spinning of the air in said cavity which would not enable the impact holes to be fed effectively with air. In addition, air passing holes extending between the inside and outside surfaces cannot be provided at the downstream end of the band, since the reintroduction of air downstream from the throat of the nozzle in a zone in which airflow is supersonic would risk significantly degrading the aerodynamic performance of the turbine.

What is claimed is:

1. A high-pressure turbine nozzle-vane band for a gas turbine engine, the band comprising:

an inside surface supporting at least one guide vane having a trailing edge that is directed towards a downstream end of the band; and an outside surface, opposite the inside surface, from which a flange extends radially, defining firstly, upstream from the flange, a passage for cooling-air, and secondly, downstream from the flange, a cavity, wherein the inside surface of the band is provided, only between the trailing edge of the guide vane and the downstream end of the band, with a coating forming a thermal barrier enabling a temperature gradient generated in the band by the air spinning in said cavity to be increased.

2. A band according to claim 1, wherein the thermal-barrier-forming coating has a surface which is substantially flush with the inside surface of the band upstream from the thermal barrier.

3. A band according to claim 1, wherein the outside surface of the band includes spoiler projections extending between the flange and the downstream end of the band.

4. A band according to claim 3, wherein the spoiler projections are ribs extending substantially parallel to an axis of the turbine.

5. A band according to claim 3, wherein the spoiler projections are ribs that are substantially inclined relative to an axis of the turbine.

6. A band according to claim 3, wherein the spoiler projections are curved ribs.

7. A band according to claim 3, wherein the spoiler projections are studs.

8. A band according to claim 7, wherein the studs are aligned in rows that are substantially parallel to an axis of the turbine.

9. A band according to claim 7, wherein the studs are disposed in staggered rows.

10. A band according to claim 1, wherein the outside surface of the band includes, upstream from the flange, at least an impact sheet so as to ensure that said band is cooled by impact.

11. A band according to claim 1, wherein the band is pierced, upstream from the flange, by a plurality of air-passing holes designed to ensure that said band is cooled by a film of air.

12. A high-pressure turbine nozzle for a gas turbine engine, the nozzle including at least a top band and at least a bottom band according to claim 1.

* * * * *